United States Patent [19]

West et al.

[11] 3,949,762

[45] Apr. 13, 1976

[54] FIBRES

[76] Inventors: Anthony Alfred West, 49, Brendon, Basildon, Essex; Derek Anthony King, 7, Clement Green Lane, South Woodham, Ferrers, Essex, both of England

[22] Filed: Nov. 7, 1974

[21] Appl. No.: 521,878

[30] Foreign Application Priority Data

Nov. 13, 1973 United Kingdom ..... 52721/73

[52] U.S. Cl. ..... 131/2; 131/17 R; 131/140 C; 131/144

[51] Int. Cl.[2] ..... A24B 15/00; A24D 1/18

[58] Field of Search ..... 131/2, 15, 17, 140 C, 144

[56] References Cited

UNITED STATES PATENTS 2,769,734 11/1956 Bandel ..... 131/15 R 3,070,486 12/1962 Novak ..... 131/15 R X

FOREIGN PATENTS OR APPLICATIONS 1,157,574 7/1969 United Kingdom ..... 131/2

*Primary Examiner*—Robert W. Michell
*Assistant Examiner*—V. Millin
*Attorney, Agent, or Firm*—Roylance, Abrams, Berdo & Kaul

[57] ABSTRACT

A process is provided for manufacturing a smokeable material including a basic material consisting of calcium alginate in fibrous form into which filler material is incorporated. The calcium alginate fibers are formed from the admixture of two solutions, the filler material being suspended in at least one of the solutions in such quantity and the solutions being so mixed that the filler is incorporated integrally in the fibres as they are formed so as to constitute more than 10% of the fibres by weight.

7 Claims, 18 Drawing Figures

Figure 5:
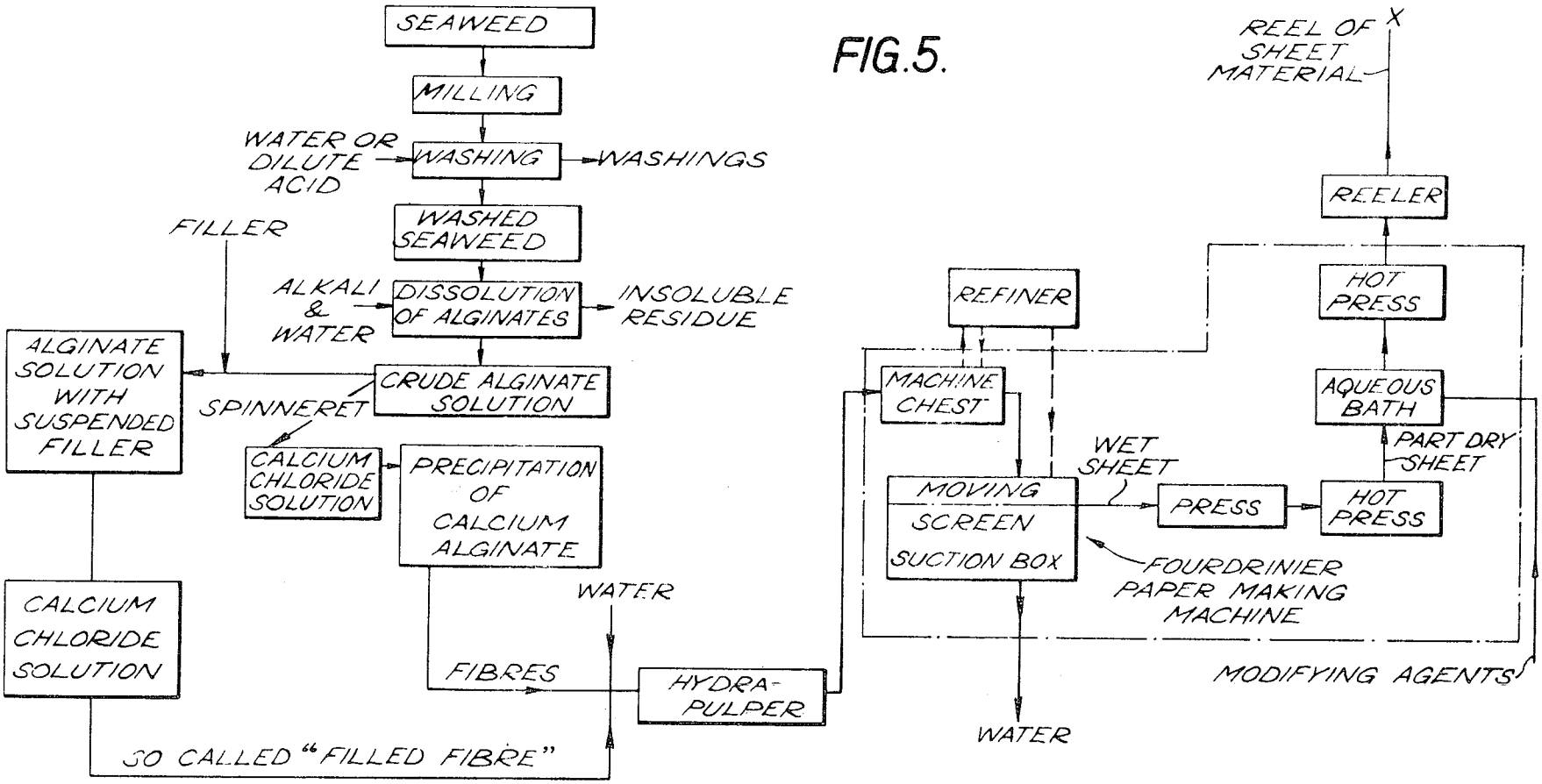

FIG.7.

EXPERIMENTS & RESULTS "FILLED FIBRES"

| | |
|---|---|
| FIG.8. | FIG.8A. |
| FIG.9. | FIG.9A. |

FIG.1.

EXPERIMENTS AND RESULTS "FILLED FIBRES"

| | |
|---|---|
| FIG. 2. | FIG. 2A. |
| FIG. 3. | FIG. 3A. |
| FIG. 4. | FIG. 4A. |

FIG. 2.

| EXPERI-MENT NO. | CALCIUM ALGINATE DETAILS "CA 33" GRADE ex ALGINATE INDUSTRIES LTD | | | ANHYDROUS SODIUM CARBONATE DRY WEIGHT | FILLER DETAILS | | DRY CALCIUM CHLORIDE WEIGHT USED | SOLUTION CONTAINING FILLER. | FILLER CONTENT. (WT. FILLER / WT. FILLED SHEET) ******** | METHODOLOGY | |
|---|---|---|---|---|---|---|---|---|---|---|---|
| | MOISTURE CONTENT. | CHARGE WEIGHT | DRY WEIGHT | | TYPE | DRY CHARGE WEIGHT | | | | LIQUOR ADDITION ORDER | METHOD OF ADDITION (NOTE 2) |
| 1 | ~20 % | 240g | 192g | 45·0g | GROUND ACTIVE CARBON** | 120g | 106g | ALGINATE | 19·3 % | | |
| 2 | " | " | " | " | | " | " | " | " | | |
| 3 | " | " | " | " | GROUND ACTIVE CARBON*** | " | " | " | " | | |
| 4 | " | " | " | " | | " | " | " | " | | |
| 5 | ~67 % | 290g | 96g | 29g | CALCIUM CARBONATE | 120g | " | " | 55·6 % | CALCIUM CHLORIDE ADDED TO ALGINATE | POURING |
| 6 | " | " | " | " | GROUND ACTIVE CARBON*** | " | " | " | " | | |
| 7 | ~20 % | 11·4g | 9·1g | 2·9g | CALCIUM CARBONATE | 12 g | 7 6g | " | 43·0 % | | |
| 8 | " | " | " | " | GROUND ACTIVE CARBON*** | " | " | " | " | | |
| 9 | ~30% | 13·3g | 9·1g | 2·9g | GROUND ACTIVE CARBON*** | 1·3g | 8·0g | ALGINATE | 11·9 % | | |
| 10 | " | " | " | " | " | 4·3g | " | " | 30·9% | | |
| 11 | " | " | " | " | " | 10·0g | " | " | 51 % | CALCIUM CHLORIDE ADDED TO ALGINATE | POURING |
| 12 | " | " | " | " | " | 23·5g | " | " | 71% | | |
| 13 | " | " | " | " | " | 56·6g | " | " | 85% | | |
| 14 | " | " | " | " | " | 190·0g | " | " | 95% | | |
| 15 | ~30% | 13·3g | 9·1g | 2·9g | CARBON BLACK "CHANNEL" **** | 1·3g | 8·0g | ALGINATE | 11·9 % | | |
| 16 | " | " | " | " | " | 4·3g | " | " | 30·9 % | CALCIUM CHLORIDE ADDED TO ALGINATE | POURING |
| 17 | " | " | " | " | " | 10·0g | " | " | 51 % | | |
| 18 | " | " | " | " | " | 23·5g | " | " | 71% | | |
| 19 | " | " | " | " | " | 56·6g | " | " | 85% | | |

FIG. 2A.

| QUALITY OF HAND PAPER SHEETS, AND FIBRES, MADE | COMMENTS | EXPERIMENT NO. |
|---|---|---|
| POOR FIBRES, POOR SHEET | 50% WT/WT DILUTION OF "CA33" FIBRES ADMIXED TO LEND SUPPORT TO SHEET | 1 |
| EXCELLENT FIBRES AND SHEETS | 50% WT/WT DILUTION OF "α-CELLULOSE" FIBRES ADMIXED TO LEND SUPPORT TO SHEET | 2 |
| FAIR FIBRES, POOR SHEET | NO DILUTION FIBRES USED | 3 |
| FAIR FIBRES AND SHEET | | 4 |
| FAIR FIBRES, POOR SHEET | | 5 |
| " | | 6 |
| GOOD FIBRES AND SHEET | SLIGHT SKIN FORMATION DURING SOLUTION ADDITION | 7 |
| " | | 8 |
| FAIR FIBRES AND SHEET | | 9 |
| " | | 10 |
| " | SHORT, HIGHLY FIBRILLATED FIBRES | 11 |
| " | | 12 |
| " | | 13 |
| FEW FIBRES FORMED ? | WOULD NOT FORM ANY FIBRES IN USEFUL QUANTITY | 14 |
| FAIR FIBRES AND SHEET | | 15 |
| " | | 16 |
| " | SHORT, FIBRILLATED "ARACHNOIDAL" FIBRES | 17 |
| " | | 18 |
| " | | 19 |

FIG. 3.

| | | | | | | | | | | | | |
|---|---|---|---|---|---|---|---|---|---|---|---|---|
| 20 | ~30% | | | | | | | | 10% | | | |
| 21 | " | EXPERIMENT 12. REPEATED TO PROVIDE A "71% FILLED" FIBRE STOCK, AND SUFFIC- | | | | | | | 20% | | | |
| 22 | " | -IENT 100% BEATEN "CA33" STOCK ADDED TO PROVIDE FINAL PAPER SHEETS | | | | | | | 50% | | | |
| 23 | " | CONTAINING: | | | | | | | 60% | CALCIUM CHLORIDE | POURING | |
| 24 | " | EXPERIMENT 18 REPEATED TO PROVIDE A "71% FILLED" FIBRE STOCK, AND SUFFIC- | | | | | | | 10% | ADDED TO ALGINATE | | |
| 25 | " | -IENT 100% BEATEN "CA33" STOCK ADDED TO PROVIDE FINAL PAPER SHEETS | | | | | | | 20% | | | |
| 26 | " | CONTAINING: | | | | | | | 50% | | | |
| 27 | " | | | | | | | | 60% | | | |
| 28 | ~22% | 5·6g | 4·4g | 2·1g | GROUND TOBACCO | 0·56g | 4·4g | ALGINATE | 11·2% | | | |
| 29 | " | " | " | " | " | 1·12g | " | " | 20·3% | | | |
| 30 | " | 6·7g | 5·3g | " | " | 0·30g | " | " | 5·4% | | | |
| 31 | " | " | " | " | " | 0·62g | " | " | 10·5% | | | |
| 32 | " | " | " | " | " | 1·4g | " | " | 20·9% | | | |
| 33 | " | " | " | " | " | 2·4g | " | " | 31·2% | CALCIUM CHLORIDE | POURING | |
| 34 | " | " | " | " | " | 3·73g | " | " | 41·3% | ADDED TO ALGINATE | | |
| 35 | " | " | " | " | " | 5·6g | " | " | 51·4% | | | |
| 36 | " | " | " | " | " | 8·4g | " | " | 61·4% | | | |
| 37 | " | " | " | " | " | 13·1g | " | " | 72·3% | | | |
| 38 | " | " | " | " | " | 22·4g | " | " | 80·9% | | | |
| 39 | ~22% | 6·7g | 5·3g | 2·1g | CALCIUM CARBONATE | 0·62g | 4·4g | ALGINATE | 10·5% | | | |
| 40 | " | " | " | " | " | 1·9g | " | " | 26·0% | | | |
| 41 | " | " | " | " | " | 3·73g | " | " | 41·3% | | | |
| 42 | " | " | " | " | " | 8·4g | " | " | 61·3% | CALCIUM CHLORIDE | POURING | |
| 43 | " | " | " | " | CALCIUM CARBONATE | 0·62g | " | " | 10·5% | ADDED TO ALGINATE | | |
| 44 | " | " | " | " | " | 1·9g | " | " | 26·0% | | | |
| 45 | " | " | " | " | " | 3·73g | " | " | 41·3% | | | |
| 46 | " | " | " | " | " | 8·4g | " | " | 61·3% | | | |

| | | |
|---|---|---|
| GOOD FIBRES, VERY GOOD SHEETS | IMPROVEMENT IN SHEET QUALITY DUE TO STRUCTURAL SUPPORT OF "PURE" "CA33" FIBRES | 20 |
| " | | 21 |
| " | | 22 |
| " | | 23 |
| " | | 24 |
| " | | 25 |
| " | | 26 |
| " | | 27 |
| EXCELLENT FIBRES AND SHEETS | FIBRES VERY SIMILAR TO NORMAL CELLULOSE PAPERMAKING FIBRES | 28 |
| " | | 29 |
| " | | 30 |
| " | | 31 |
| " | | 32 |
| " | | 33 |
| " | | 34 |
| " | | 35 |
| " | SOME TOBACCO FILLER LOST INTO 'WHITE-WATER' | 36 |
| " | | 37 |
| FIBRES FAIR, SHEETS VERY POOR | | 38 |
| GOOD FIBRES AND SHEETS | NO FILLER LOSSES TO 'WHITE-WATER' NOTED | 39 |
| " | | 40 |
| " | | 41 |
| " | | 42 |
| " | | 43 |
| " | | 44 |
| " | | 45 |
| " | | 46 |

FIG. 3A.

| | | | | | | | | | | | |
|---|---|---|---|---|---|---|---|---|---|---|---|
| 47 | ~22% | 6·7g | 5·3g | 2·1g | CALCIUM CARBONATE | 5·6g | 4·4g | ALGINATE | 51 4% | CALCIUM CHLORIDE ADDED TO ALGINATE | POURED |
| 48 | " | " | " | " | ****** " | " | " | " | " | ALGINATE ADDED TO | " |
| 49 | " | " | " | " | " | " | " | CALCIUM | " | CALCIUM CHLORIDE | " |
| 50 | " | " | " | " | " | " | " | CHLORIDE | " | CALCIUM CHLORIDE ADDED TO ALGINATE | " |
| 51 | " | " | " | " | " | " | " | ALGINATE | " | ALGINATE ADDED TO | SQUIRTED |
| 52 | " | " | " | " | " | " | " | " | " | CALCIUM CHLORIDE | SPRAYED |
| 53 | " | " | " | " | " | " | " | " | " | | " |
| 54 | " | " | " | " | " | " | " | CALCIUM | " | CALCIUM CHLORIDE | " |
| 55 | " | " | " | " | " | " | " | CHLORIDE | " | ADDED TO ALGINATE | SQUIRTED |
| 56 | " | " | " | " | " | " | " | | " | ALGINATE ADDED TO CALCIUM CHLORIDE | " |
| 57 | ~22% | 6·7g | 5·3g | 1·15g | CALCIUM CARBONATE | 2·8g | 1·2g | ALGINATE | 35% | CALCIUM CHLORIDE ADDED TO ALGINATE | POURED |
| 58 | EXPERIMENT 57 REPEATED TO PROVIDE FURTHER SOLUTIONS OF FIBRE PRECURSOR ALGINATE AND CALCIUM | | | | | | | | | ALGINATE ADDED TO | SQUIRTED WITH ULT--RASONIC AGITATION |
| 59 | | | | | CHLORIDE | | | | | EXCESS CALCIUM CHLORIDE | SQUIRTED WITH NO AGITATION |

* DETERMINED BY DRYING AT 110°C FOR 24 HRS AND REWEIGHING.

** GRADE MF3, *ex.* CHEMVIRON LTD, GRAYS, ESSEX.

*** GRADE 205C, *ex.* SUTCLIFFE SPEAKMAN LTD.

**** GRADE 1430, *ex.* D.F. ANSTEAD, BILLERICAY, ESSEX.

***** A FULL BLEND OF BOTH LEAF 'LAMINA' (80%) AND 'STEM' (20%).

****** SIEVED TO B.S. 150–200 MESH RANGE.

******* SIEVED TO PASS B.S. 200 MESH SIEVE.

******** EXCLUDES ANY CALCIUM CARBONATE FORMED BY REACTION OF EXCESS SODIUM CARBONATE WITH CALCIUM CHLORIDE.

NOTE 2: THE SOLUTION RECEIVING THE ADDED SOLUTION IS AGITATED SLOWLY EITHER MECHANICALLY OR BY HAND DURING THE COURSE OF ADDITION.

FIG. 4.

| | | |
|---|---|---|
| GOOD FIBRES AND SHEETS | FIBRES AND PAPER VERY SIMILAR, NO PREFERENCE FOR METHOD | 47 |
| " | | 48 |
| POOR FIBRES AND SHEETS | NOT ALL FILLER INCORPORATED. POOR METHOD | 49 |
| " | | 50 |
| FAIR FIBRES AND SHEETS | INITIAL PRODUCTION OF 'WORMS' WHICH COULD BE DISINTEGRATED TO REASONABLE FIBRES | 51 |
| GOOD FIBRES AND SHEETS | FINE FIBRES AND SOME 'SKIN', WHICH COULD BE DISINTEGRATED BY AGITATION TO GOOD FIBRES | 52 |
| NO FIBRES FORMED | A SOLID AGGLOMARATE FORMED — NO FIBRES | 53 |
| POOR FIBRES | FILLER LOST — POOR METHOD | 54 |
| " | VERY LITTLE FIBROUS MATERIAL FORMED, SOME FILLER LOST. POOR METHOD | 55 |
| " | —— " —— | 56 |
| FEW FIBRES FORMED | STOECHIOMETRIC EXPERIMENT, SOME FIBRES, POOR OVERALL YIELD. POOR METHOD | 57 |
| VERY GOOD FIBRES AND PAPERS | SMALL, FLUFFY FIBRES. EXCELLENT METHOD | 58 |
| " | —— " —— | 59 |

FIG. 4A.

FIG. 6.

PAPER MACHINE CONDITIONS FOR BOTH RUNS OF EXAMPLES A, B, AND C

| VARIABLE | SETTING | VARIABLE | SETTING |
|---|---|---|---|
| LINEAR WIRE SPEED | 17 ft./min. | 1st BOX VACUUM | ( 0" Hg ( RUN 1)<br>( 0-1" Hg (RUN 2) |
| SUBSTANCE | 150 gsm DRY WEIGHT | BELT VACUUM (1,2,3) | 2" Hg |
| DRY FIBRE TO WIRE FLOW RATE | 390 gm./min. | COUCH VACUUM | 2" Hg |
| THICK STOCK FLOW @ 0·5 % ) CONSISTENCY) | (78·0 LITRES / min. (RUN 1)<br>(80·5 LITRES / min. (RUN 2) | 1st PRESS: VACUUM | 2" Hg |
| WHITE WATER FLOW RATE) ) | (58·5 LITRES / min. (RUN 1)<br>(60·0 LITRES / min. (RUN 2) | NIP PRESSURE<br>FELT TENSION | 40 LB./ LINEAR INCH<br>400 p.s.i. |
| SHAKE STROKE | 3/16" | 2nd PRESS: NIP PRESSURE<br>FELT TENSION<br>DRYER'S FELT TENSION ( TOP + BOTTOM ) | 60 LB./LINEAR INCH<br>400 p.s.i.<br>800 p.s.i. |

CYLINDER STEAM PRESSURES AND CONSEQUENT TEMPERATURES

| CYLINDER NO: | 1 | 2 | 3 | 4 | 5 | 6 | 7 | 8 | 9 |
|---|---|---|---|---|---|---|---|---|---|
| STEAM PRESSURE | 0 | 2 | 0 | 2 | 0 | 0 | 0 | 0 | VARIED TO SUIT |
| CYLINDER TEMPERATURE °C | 35 | 82 | 42 | 80 | 81 | 40 | 40 | 80 | VARIABLE. MEAN 78 |

FIG. 8.

| 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|
| | SODIUM ALGINATE | | | | | | | | CALCIUM CHLORIDE | | | | | | CALCIUM CARBONATE (SEE FOOT NOTE 1) | |
| EXPERIMENT NO | TYPE (SEE FOOT NOTE 2) | %SODIUM ALGINATE IN THIS TYPE | WEIGHT PRODUCT USED (g) | WEIGHT SODIUM ALGINATE (g) | VOLUME OF WATER TO DISSOLVE ALGINATE (ml) | SODIUM ALGINATE CONC WT/VOL% | TEMP. OF ALGINATE FEEDSTOCK °C | pH OF ALGINATE FEEDSTOCK | TYPE OF SOLID (SEE FOOT NOTE 3) | TYPE OF LIQUOR (SEE FOOT NOTE 4) | $CaCl_2$ SOLUTION CONC WT/VOL% | VOLUME $CaCl_2$ SOLUTION (ml) | TEMP OF $CaCl_2$ SOLUTION °C | pH OF $CaCl_2$ SOLUTION | WEIGHT (g) | CARRIED IN WHICH FEEDSTOCK SOLUTION |
| S14 | DM3 | 88 | 9·3 | 8·2 | 820 | 1 | 28 | 6·5 | H.W. G.PR | | 4 | 105 | 20 | 6·6 | 8·1 | $CaCl_2$ |
| S15 | " | " | " | " | " | " | 24 | " | " | | " | " | " | " | " | ALGINATE |
| S16 | " | " | " | " | " | " | " | " | " | | " | " | " | " | " | " |
| S17 | WEIGUM | 65 | 12·6 | " | " | " | 27 | 9·1 | | ICI LIQUOR | 7·5 | 100 | 20 | 5·5 | " | " |
| S18 | DM3 | 88 | 9·3 | " | " | " | 30 | 6·9 | | " | " | " | " | " | 10·0 | $CaCl_2$ |
| S19 | " | " | " | " | " | " | 27 | 8·0 | | " | " | " | 22 | " | " | ALGINATE |
| S20 | DH3 | 85 | 9·6 | " | " | " | 31 | 8·2 | | " | " | " | " | " | " | " |
| S21 | DM3 | 88 | 9·3 | " | " | " | " | 8·0 | | " | " | " | 18 | 7·0 | " | " |
| S22 | " | " | " | " | " | " | 30 | 6·5 | | " | " | " | 20 | " | " | $CaCl_2$ |
| S23 | " | " | " | " | " | " | 33 | 8·0 | | " | " | " | " | " | " | ALGINATE |
| S24 | " | " | " | " | " | " | 34 | 6·4 | | " | " | " | " | " | " | $CaCl_2$ |
| S25 | WEIGUM | 65 | 12·6 | " | " | " | " | 9·2 | | " | " | " | " | 7·5 | 8·1 | " |
| S26 | DH3 | 85 | 9·6 | " | " | " | 29 | 6·5 | | " | " | " | " | " | 10·0 | " |
| S27 | " | " | " | " | " | " | 33 | 6·5 | | " | " | " | " | 6·9 | " | " |
| S28 | " | " | " | " | " | " | 25 | " | | " | " | " | " | " | " | " |
| S29 | " | " | " | " | " | " | 28 | 6·3 | | " | " | " | 19 | 6·8 | " | " |
| S30A | " | " | " | " | " | " | 33 | 6·5 | | " | " | " | 20 | 7·0 | NONE | — |
| S30B | " | " | " | " | " | " | 35 | " | | " | " | " | " | " | 12·0 | $CaCl_2$ |
| S31A | " | " | " | " | " | " | 26 | " | | " | " | " | 21 | 6·7 | NONE | — |
| S31B | " | " | " | " | " | " | 29 | " | | " | " | " | " | " | 24·0 | $CaCl_2$ |
| S32 | WEIGUM | 65 | 12·6 | " | " | " | 39 | 9·0 | | " | " | " | 19 | 7·2 | 8·1 | " |
| S33 | " | " | " | " | " | " | 32 | 9·2 | | " | " | " | 21 | 7·1 | " | " |
| S34 | " | " | " | " | " | " | 11 | 9·0 | | " | " | " | " | 6·7 | " | " |

FIG. 8A.

| 18 | 19 | 20 | 21 | 22 | 23 | 24 | 25 | 26 | 27 | 28 | 29 | 30 | 31 |
|---|---|---|---|---|---|---|---|---|---|---|---|---|---|
| CARBON | | | | | | | | THEORETICAL DRY COMPOSITION OF FIBRES | | | | | |
| TYPE | APPROX MESH SIZE | WEIGHT (g) | CARRIED IN WHICH FEED-STOCK SOLUTION | ORDER OF ADDITION OF LIQUORS | RATE OF ADDITION OF ADDED LIQUOR mls/min | DURATION OF ADDITION | METHOD OF AGITATION (SEE FOOT-NOTE 5) | CALCIUM ALGINATE | CALCIUM CARBON-ATE | CARBON | COMMENTS ON APPEARANCE AND PREPARATION OF FIBRES | COMMENTS ON HANDSHEETS | EXPERI-MENT NO. |
| CHANNEL | μm SIZE | 0·7 | $CaCl_2$ | ALG-$CaCl_2$ | 150 | 5·5 | A | 42·5 | 54 | 3·5 | GOOD SOME FALL OUT OF CARBON | GOOD VERY FLEXIBLE | S14 |
| " | " | 1·0 | ALGINATE | " | " | " | " | 42 | 53 | 5 | GOOD " | GOOD. | S15 |
| " | " | 0·8 | " | " | " | " | " | " | 54 | 4 | GOOD | GOOD. | S16 |
| " | " | 1·0 | " | " | " | " | " | " | 53 | 5 | GOOD | GOOD | S17 |
| " | " | 0·8 | " | " | " | " | " | " | 54 | 4 | GOOD SOME FALL OUT OF $CaCO_3$ | GOOD | S18 |
| " | " | 1·0 | " | " | " | " | " | " | 53 | 5 | GOOD SOME CARBON FALL OUT | FAIR | S19 |
| " | " | " | " | " | " | " | " | " | " | " | GOOD | GOOD | S20 |
| " | " | " | " | " | " | " | " | " | " | " | GOOD SOME FALL OUT OF FILLERS | GOOD | S21 |
| " | " | " | $CaCl_2$ | " | " | " | " | " | " | " | GOOD. | GOOD FLEXIBLE | S22 |
| " | " | " | " | " | " | " | " | " | " | " | GOOD SOME FALL OUT OF FILLERS | GOOD | S23 |
| " | " | " | ALGINATE | " | " | " | " | " | " | " | GOOD LARGE FALL OUT OF CARBON | GOOD | S24 |
| " | " | " | $CaCl_2$ | " | " | " | " | " | " | " | GOOD. | GOOD (SEE FOOTNOTE 6) | S25 |
| " | " | " | " | " | " | " | " | " | " | " | GOOD | GOOD | S26 |
| NONE | — | — | — | " | " | " | " | 45 | 55 | 0 | GOOD. SOME $CaCO_3$ FALL OUT | EXCELLENT (SEE FOOTNOTE 7) | S27 |
| CHANNEL ACTIVATED | μm SIZE 50-400 | 0·2 | $CaCl_2$ | " | " | " | " | 44·5 | 54·5 | 1 | GOOD SOME FALL OUT OF CARBON | EXCELLENT | S28 |
| | | 0·8 | ALGINATE | " | " | " | " | 42 | 54 | 4 | GOOD SOME $CaCO_3$ FALL OUT | GOOD | S29 |
| CHANNEL | μm SIZE | 8·0 | " | " | " | " | " | 50 | 0 | 50 | GOOD SOME FALL OUT OF CARBON | FAIR — FIBRES MIXED IN RATIO 1xA : 4xB | S30A |
| NONE | — | — | — | " | " | " | " | 40 | 60 | 0 | GOOD | EXCE-LLENT — GOOD SPECKLED SHEETS OF COMPOSITION 42:48:10 | S30B |
| CHANNEL | μm SIZE | 24·0 | ALGINATE | " | " | " | " | 25 | 0 | 75 | GOOD SMALL FALL OUT OF CARBON | FAIR — FIBRES MIXED IN RATIO 1xA : 7xB | S31A |
| NONE | — | — | — | " | " | " | " | 25 | 75 | 0 | GOOD SMALL FALL OUT OF $CaCO_3$ | GOOD — GOOD SPECKLED SHEETS OF COMPOSITION 25 65:10 | S31B |
| ACTIVATED | 200-400 | 1·0 | ALGINATE | " | " | " | " | 42 | 53 | 5 | GOOD | GOOD | S32 |
| " | " | | $CaCl_2$ | " | " | " | " | " | " | " | GOOD. VERY LARGE FALL OUT OF CARBON | GOOD | S33 |
| " | " | | ALGINATE | " | " | " | " | " | " | " | GOOD | GOOD | S34 |

| 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|
| | SODIUM ALGINATE | | | | | | | | CALCIUM CHLORIDE | | | | | | CALCIUM CARBONATE (SEE FOOTNOTE 1) | |
| EXPERI-MENT NO. | TYPE (SEE FOOT NOTE 2) | %SODIUM ALGINATE IN THIS TYPE | WEIGHT PRODUCT USED (g) | WEIGHT SODIUM ALGINATE (g) | VOLUME OF WATER TO DISSOLVE ALGINATE (ml) | SODIUM ALGINATE CONC WT/VOL% | TEMP. OF ALGINATE FEEDSTOCK °C | pH OF ALGINATE FEEDSTOCK | TYPE OF SOLID (SEE FOOT NOTE 3) | TYPE OF LIQUOR (SEE FOOT NOTE 4) | $CaCl_2$ SOLUTION CONC WT/VOL% | VOLUME $CaCl_2$ SOLUTION (ml) | TEMP OF $CaCl_2$ SOLUTION °C | pH OF $CaCl_2$ SOLUTION | WEIGHT (g) | CARRIED IN WHICH FEEDSTOCK SOLUTION |
| C1 | WELGUM | 65 | 93·3 | 60·8 | 6,000 | 1 | 22 | 9·0 | | ICI LIQUOR | 7·5 | 625 | 20 | 7·3 | 116·0 | $CaCl_2$ |
| C2 | " | " | " | " | " | " | " | " | | " | 10 | 800 | 22 | " | " | |
| C3A | " | " | 15·5 | 10·0 | 1,000 | " | " | " | | " | 9·5 | 133 | " | 7·4 | NONE | |
| C3B | " | " | 77·7 | 50·0 | 5,000 | " | " | " | | " | " | 667 | " | " | 115·0 | |
| C4 | " | " | 62·2 | 40·0 | 4,000 | " | " | " | | " | " | 600 | " | 7·5 | 140·0 | |
| C5 | " | " | 93·3 | 60·0 | 6,000 | " | " | " | | " | 10 | 800 | " | " | 124·0 | |
| C6 | " | " | " | " | " | " | " | " | | " | " | " | " | " | 126·0 | |
| C7 | " | " | " | " | " | " | " | " | | " | " | " | " | " | 106·0 | |
| C8 | " | " | 31·1 | 20·0 | 2,200 | 0·9 | " | " | | " | " | 600 | " | " | 173·0 | |
| | | | | | | | | | | | | | | | | |
| P1 | " | " | 933 | 600 | 60,000 | 1 | " | " | | " | 7·5 | 6,000 | " | 7·4 | 1,233 | |
| | | | | | | | | | | | | | | | | |
| P2 | " | " | 31·1K | 20·0K | 2,000 L | 1 | " | " | | " | 10·2 | 200L | " | 8·0 | 75K | |

FIG. 9.

FOOTNOTES

1. CALCIUM CARBONATE EX. J & E STURGE BIRMINGHAM TYPE P C C H (99% $CaCO_3$)
2. SODIUM ALGINATE EX. ALGINATE INDUSTRIES LTD LONDON TYPE WELGUM (C. 65% SODIUM ALGINATE, C 16% CALCIUM CARBONATE)
   MANUCOL DH3 (C. 85% SODIUM ALGINATE)
   MANUCOL DM3 (C.88% SODIUM ALGINATE)
3. CALCIUM CHLORIDE EX. HOPKIN & WILLIAMS TYPE GPR ( 91% $CaCl_2$)
4. CALCIUM CHLORIDE LIQUOR EX IMPERIAL CHEMICAL INDUSTRIES LTD (37·5% $CaCl_2$)
5. METHODS OF AGITATION
   A. SILVERSON MIXER MODEL 'L2R', FITTED WITH DISINTEGRATING HEAD. 3,000 RPM.
   B. SILVERSON MIXER MODEL 'PILOT,' FITTED WITH DISINTEGRATING HEAD 3,000 RPM. ALGINATE FEEDLINE DETAILS IN FIG. 11.
6. CONTAINED 1200 PPM SODIUM ON DRY WEIGHT
7. A MIXTURE CONTAINING 50% FIBRES FROM EXPERIMENT 27 AND 50% FIBRES FROM EXPERIMENT 24 WAS PREPARED. SHEETS MADE FROM THE MIXTURE WERE SPECKLED AND OF GOOD QUALITY.

FIG. 9A.

| 18 | 19 | 20 | 21 | 22 | 23 | 24 | 25 | 26 | 27 | 28 | 29 | 30 | 31 |
|---|---|---|---|---|---|---|---|---|---|---|---|---|---|
| CARBON | | | | | | | | THEORETICAL DRY COMPOSITION OF FIBRES | | | | | |
| TYPE | APPROX MESH SIZE | WEIGHT (g) | CARRIED IN WHICH FEED-STOCK SOLUTION | ORDER OF ADDITION OF LIQUORS | RATE OF ADDITION OF ADDED LIQUOR mls/min | DURATION OF ADDITION | METHOD OF AGITATION (SEE FOOT-NOTE 5) | CALCIUM ALGINATE | CALCIUM CARBON-ATE | CARBON | COMMENTS ON APPEARANCE AND PREPARATION OF FIBRES | COMMENTS ON HANDSHEETS | EXPERI-MENT NO. |
| CHANNEL | μm SIZE | 10·0 | ALGINATE | ALG→$CaCl_2$ | 150 | 40 | A | 30 | 65 | 5 | FAIR LARGE FALL OUT OF FILLERS | GOOD | C1 |
| ACTIVATED | 200-400 | " | " | " | " | " | " | 30 | 65 | 5 | GOOD 8 EQUAL BATCHES | | C2 |
| " | " | | " | " | " | 7 | " | 44 | 12 | 44 | GOOD | MIXED TOGETHER. GOOD SPECKLED SHEETS | C3A |
| NONE | — | — | — | " | " | 33 | " | 29 | 71 | 0 | GOOD SMALL FALL OUT OF $CaCO_3$ 7 EQUAL BATCHES | | C3B |
| ACTIVATED | 200-400 | 10·0 | ALGINATE | " | " | 27·5 | " | 20 | 75 | 5 | " " " " " " 5 EQUAL BATCHES | GOOD | C4 |
| " | " | 2·0 | " | " | " | 40 | " | 30 | 69 | 1 | VERY GOOD 8 EQUAL BATCHES | " | C5 |
| NONE | — | — | — | " | " | " | " | 30 | 70 | 0 | VERY GOOD 8 EQUAL BATCHES | " | C6 |
| ACTIVATED | 200-400 | 20·0 | ALGINATE | " | " | " | " | 30 | 60 | 10 | GOOD SMALL FALL OUT OF $CaCO_3$ 8 EQUAL BATCHES | " | C7 |
| " | " | 2·0 | " | " | " | 15 | " | 10 | 89 | 1 | " " " " " " 5 EQUAL BATCHES | " | C8 |
| NONE | — | — | — | FED TO-GETHER | ALGINATE 300 $CaCl_2$ 30 | CONTINU-OUS | B | 30 | 70 | 0 | VERY GOOD | EXCELLENT | P1 |
| ACTIVATED | 50-400 | 1000 | ALGINATE | " | ALGINATE 3,500 $CaCl_2$ 350 | " | " | 20 | 79 | 1 | GOOD | GOOD | P2 |

FIG. 13.

SMOKE ANALYSIS OF CIGARETTES MADE FROM SHREDDED HAND SHEETS

| SAMPLE CODE | COMPOSITION | | | CARBON TYPE | SMOKE ANALYSIS RESULTS | | | | | | |
|---|---|---|---|---|---|---|---|---|---|---|---|
| | % CALCIUM ALGINATE | % $CaCO_3$ | % CARBON | | T.P.M. WET (MEAN) | T.P.M. DRY (MEAN) | CO mg/cig (MEAN) | $CO_2$ mg/cig (MEAN) | GAS PHASE (COMMENT) | PUFFS (MEAN) | BURNING (COMMENTS) |
| C.1 | 30 | 65 | 5 | CHANNEL | 3·9 | 3·7 | 18·9 | 69·1 | POOR | 10·2 | FAIR |
| C.2 | 30 | 65 | 5 | ACTIVATED | 2·7 | 2·07 | 13·7 | 73·8 | " | 14·2 | " |
| C.3 | 30 | 65 | 5 | ACTIVATED | 3·7 | 2·4 | 11·1 | 63·3 | " | 11·0 | " |
| C.4 | 20 | 75 | 5 | ACTIVATED | 2·7 | 2·13 | 10·9 | 53·0 | GOOD | 8·0 | POOR |
| C.5 | 30 | 69 | 1 | ACTIVATED | 2·5 | 2·15 | 12·7 | 58·3 | POOR | 12·9 | VERY POOR |
| C.6 | 30 | 70 | 0 | NONE | 4·2 | 3·7 | 16·2 | 74·1 | " | 13·1 | POOR |
| C.7 | 30 | 60 | 10 | ACTIVATED | 3·95 | 2·3 | 21·4 | 81·0 | " | 8·7 | GOOD |
| C.8 | 10 | 59 | 1 | ACTIVATED | 1·8 | 0·5 | 1·9 | 65·4 | " | 10·7 | POOR |
| PICCA-DILLY FILTER CIGAR-RETTES | ← NOT APPLICABLE → | | | | 20·0 | 17·0 | 21·0 | 60-80 | " | 8·0 | GOOD |

FIBRES

This invention relates to the incorporation in basic fibrous materials comprising an insoluble Alginate of filler materials and is more particularly, but not exclusively of application in the manufacture of fibrous sheet material comprising an insoluble Alginate incorporating filler materials.

It has heretofore been proposed to produce insoluble alginates having a pronounced fibrous structure from alginic acid or an alkali metal alginate, which while at the same time being subjected to mechanical treatment in a mill is treated with a concentrated solution, i.e. one having a minimum cation concentration of about 7%, of a cation forming an insoluble alginate, he treatment being carried out in the presence in the mill of pigments resistant to alkalis. The object is to obtain coloured alginate fibres for use themselves merely as supplementary or filler materials in the paper industry to obtain coloured effects not attainable from colouring ordinary cellulose. Percentages are not discussed but for pigmentation purposes would be only low percentages of a few percent and in any event less than 10% would be necessary.

According to the present invention there is provided a process of incorporating filler material into a basic material comprising an insoluble alginate, which can be made in fibrous form by the admixture of two solutions, in which the filler material is suspended in at least one of the solutions in such quantity and the solutions are so mixed that the filler is incorporated integrally in the fibres as they are formed so as to constitute more than 10% of the fibres by weight.

According to another aspect of the present invention there is provided a process of manufacturing a smokeable material including a basic material consisting of calcium alginate in fibrous form, into which filler material is incorporated, in which the calcium alginate fibres are formed from the admixture of two solutions, the filler material being suspended in at least one of the solutions in such quantity and the solutions being so mixed that the filler is incorporated integrally in the fibres as they are formed so as to constitute more than 10% of the fibres by weight.

Preferably, the quantity of filler in the fibres is more than 50% by weight of the fibres.

Conveniently, substantially all the filler material including any tobacco added to the calcium alginate necessary to form the fibres from which a complete smokeable material can be made may be incorporated in the fibres as above setforth and conveniently the fibres incorporating the filler may be thereafter formed into a sheet by a paper making process and subsequently the paper shredded to form the smokeable material.

For many reasons, see below, it is desirable to add a filler. If, in a normal substantially organic smoking material it might, for example, be necessary to add 61% of inorganic filler, as calcium alginate already contains approximately 10% of inorganic material, it would only be necessary to add 51% to produce a similar smoking material composition (inorganic/organic ratio).

There are several main categories of reasons for adding filler as follows:

"Dilution" of organic material. Merely by diluting the organic content of the smoking material with inorganic material, one can obtain a reduction in the quantity of whole smoke, namely, tar and gas phases. If all the other parameters of the sheet are the same and the filler is inert, one should obtain a straight percentage reduction in the whole smoke delivery. If, however the filler is active in any way the reduction in the whole smoke will be dependent on the specific activity of the filler.

Generally fillers are cheap, readily available materials and if they can be combined in calcium alginate smoking material by a relatively cheap process one can therefore make a relatively cheap bulk smoking material.

By introducing suitable fillers one can modify the physical parameters of the sheet for example the following parameters: flexibility, opacity, porosity, hardness or the surface finish to the sheet. One can also affect useful modifications to the on-machine and off-machine processability of the sheet, for example, reduction of the shrinkage during paper making, and easing off-machine operations such as subsequent cutting, blending and handling.

Addition of suitable fillers to the sheet may chemically render the sheet more amenable to accepting modifying agents such as and particularly colours or dyes, nicotine or nicotine salts, flavours or flavouring agents, both synthetic or naturally occurring and particularly tobacco juice extracts such as are known and used in the art. This particular aspect could be very important if one were to manufacture 100% synthetic smoking material sheet and wished to incorporate modifying agents such as are mentioned above during a subsequent cutting and/or blending operation with tobacco in order to improve the transfer of flavours etc. from the tobacco to the synthetic material.

There are many fillers known and disclosed and used in the general art which have a useful effect on the combustibility of the smoking product. They can do this, for example, by altering the temperature by which the smoking material burns or glows. They can therefore affect the products of combustion, i.e. the tar and gas phase deliveries and also the ash formed from combustion. The latter is particularly useful because many synthetic smoking materials do not produce an acceptable ash unless their composition is modified, e.g., by the use of suitable fillers, Obviously one could obtain or use one filler which may affect one or more of the above properties and similarly one can use a combination of fillers to obtain a useful affect on a combination of the above properties.

There are many materials which are well-known and used in the art. We have considered the many types of filler that are available to us and consider that these fillers fall into the following categories:

1. Rock clays minerals or earths either naturally occurring or any processed or manufactured form.
2. Insoluble industrial process wastes (e.g. PFA).
3. Various inorganic compounds well-known in the paper, smoking material or tobacco art. e.g., calcium carbonate, titanium dioxide, calcium hydroxide, aluminium hydroxide and aluminium carbonate.
4. Carbon, either activated or as "black".
5. Ground wood, flour or tobacco, or other finely divided organic material.

Because of the nature of this invention it is a prerequisite that the filler material used should be substantially water insoluble.

Reference will now be made by way of example to the accompanying drawings, in which -

Figure 10:
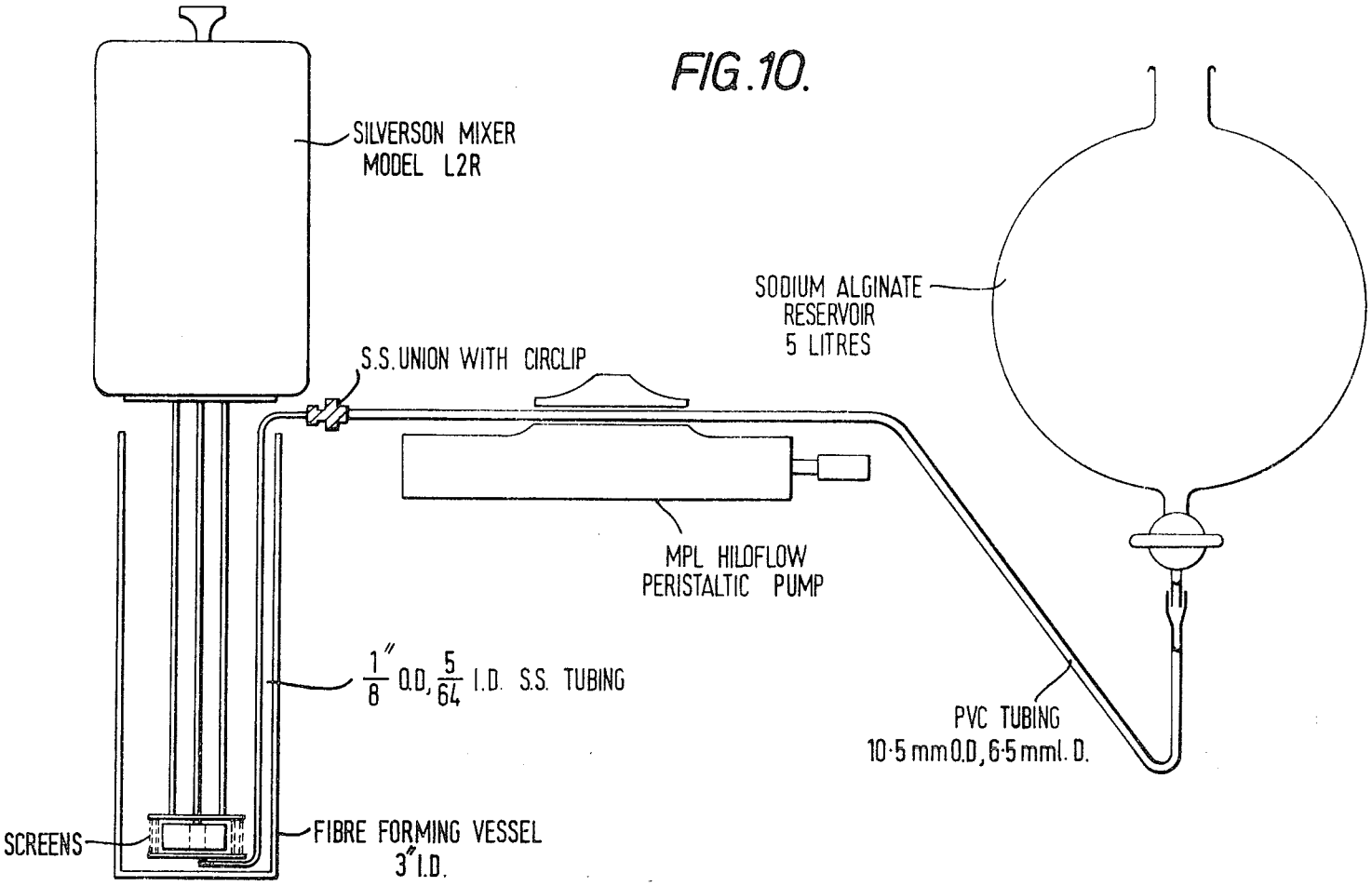
Figure 11:
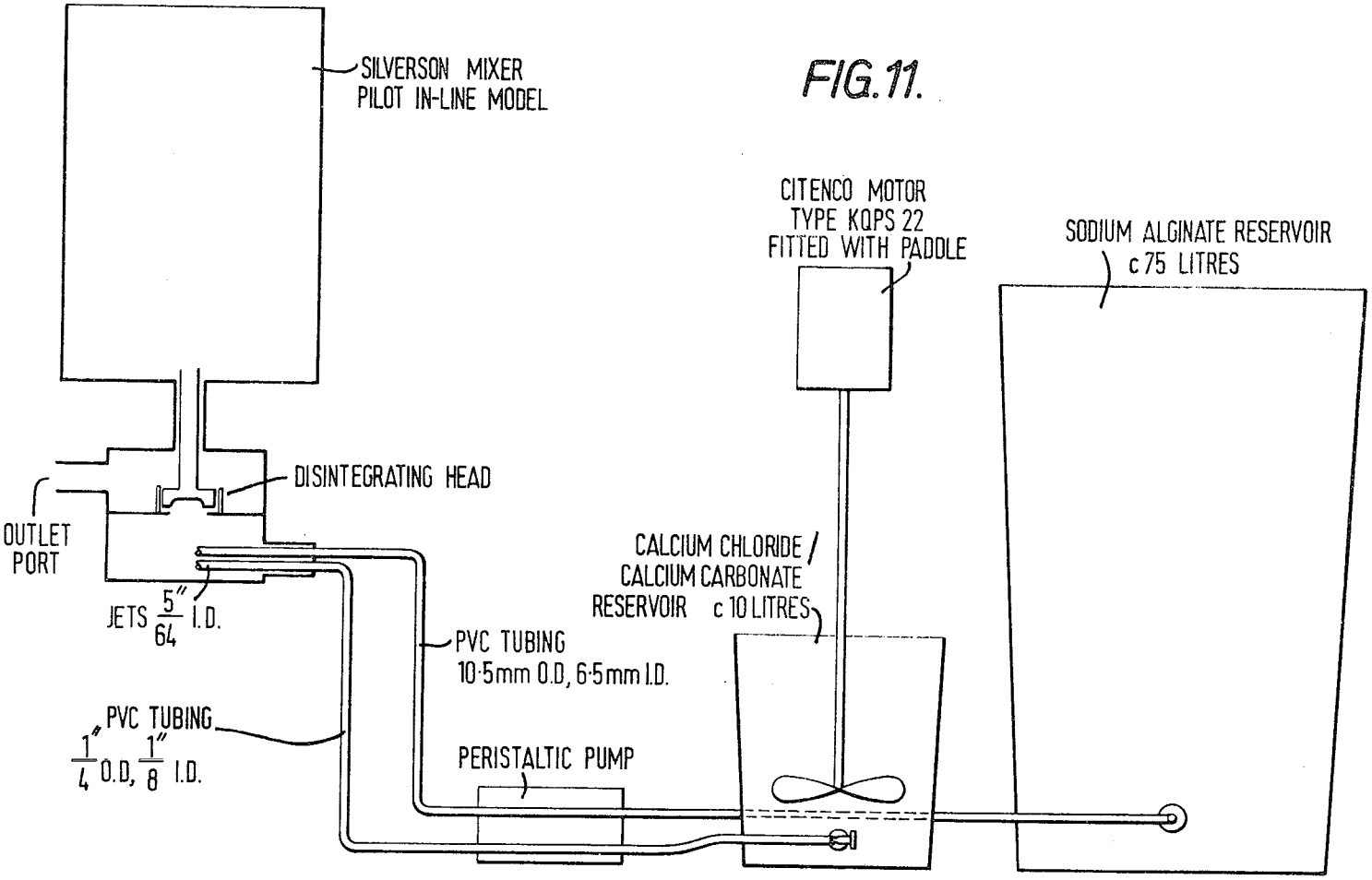
Figure 12:
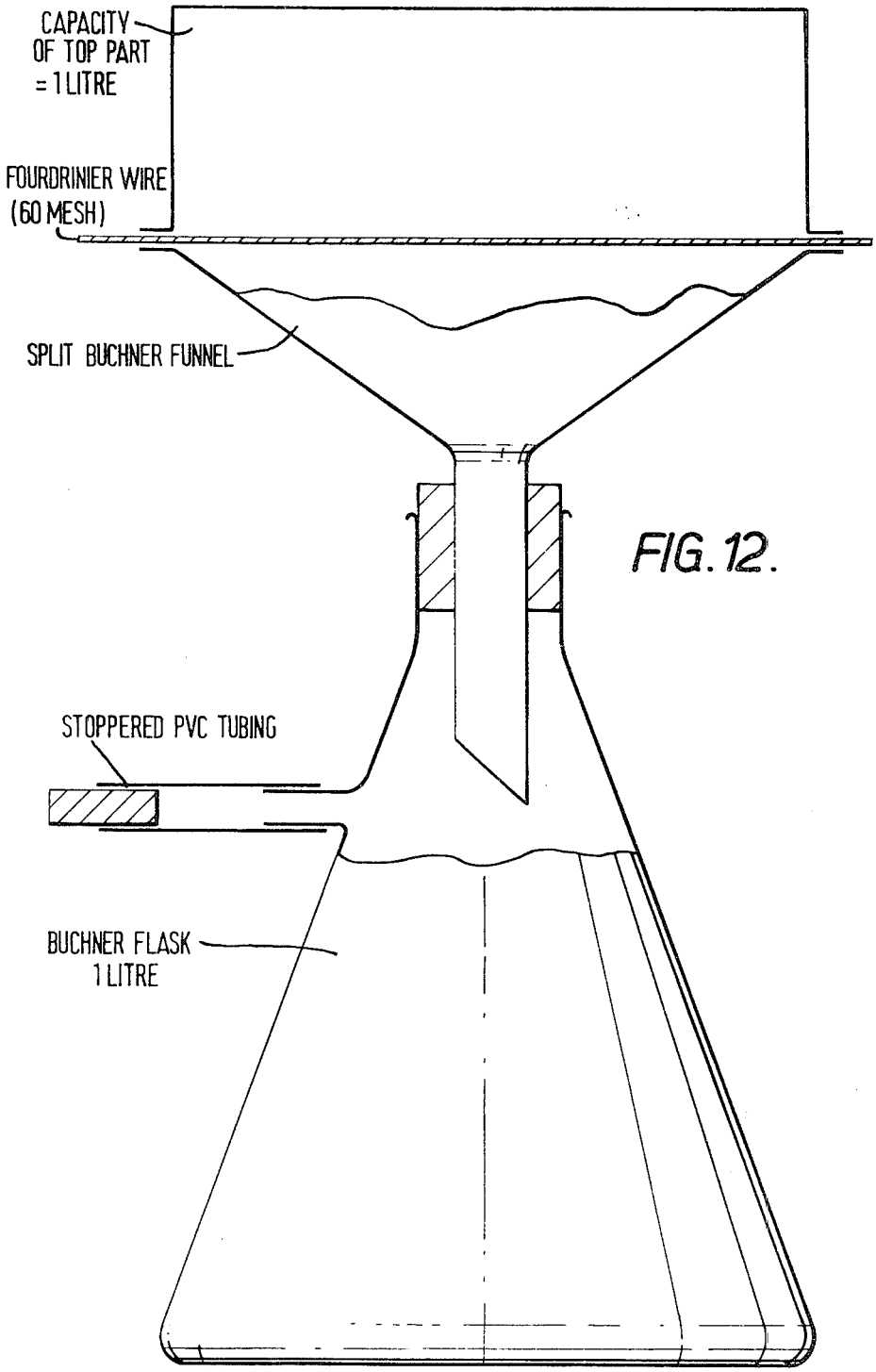

FIG. 1 is a block diagram showing the relationship of FIGS. 2, 2A, 3, 3A; 4 and 4A, which together form a chart of several series of exemplary experiments, FIG. 5 is a diagramatic flow sheet which illustrates in outline one convenient embodiment of the method according to the invention, FIG. 6 is a table of paper machine conditions for other Examples A, B and C hereinafter described, FIG. 7 is a block diagram showing the relationship of FIGS. 8, 8A; 9, 9A, which together form a chart of a further series of exemplary experiments, FIG. 10 is a schematic diagram (not to scale) of laboratory apparatus used in experiments S14–S34 incl. and C1–C8 incl., FIG. 11 is a schematic diagram (not to scale) of a pilot scale apparatus used in experiments P1 and P2, FIG. 12 is a schematic diagram (not to scale) of a simple apparatus used to form hand paper sheets in experiments S14–S34 incl. C1–C8 incl. and P1 and P2, FIG. 13 is a table of results of smoke analysis of cigarettes containing 100% shredded hand sheets from experiments C1–C8 inclusive.

Referring now to the FIG. 5, Calcium Alginate fibres are produced by the squirting of crude alginate solution via a spinneret (nozzle) into Calcium Chloride solution to precipitate Calcium Alginate in the fibrous form directly suitable for manufacture into sheet material (paper) of a paper making machine. If desired the Calcium Alginate may be recycled.

The crude alginate solution (for example Sodium Alginate) may be obtained, for example, from seaweed by the commercially known process as shown in the first stages of the left-hand side of the flow sheet. Alginic acid could be manufactured synthetically, however, thus eliminating the need to rely on seaweed as the starting material, and converted to Sodium Alginate solution which would then again be fed into the Calcium Chloride solution via the spinneret (nozzle).

Some of the Sodium Alginate solution has a filler material, such as Kaolin added to it and suspended therein by agitation. The Sodium Alginate with filler in suspension is fed into Calcium Chloride solution and the mixture agitated to separate into fibres which may be termed "filled fibres". These and the Clacium Alginate fibres per se are "pulped" and fed to the pulp chest.

EXAMPLE A.

Test scale of formation of so caled "filled fibres" and paper on a hand paper former.

140gms of dry Kaolin filler material was suspended with agitation in a first solution of 56 gms. of Calcium Alginate (dry weight basis) which had been dissolved by the addition of 21 gms. of Sodium Carbonate, total solution volume being 3 liters. This solution was passed under gravity through a glass nozzle into a second solution of 44 gms. Calcium Chloride in 3 liters of water, which was agitated slowly throughout the addition period. The precipitated "filled fibre" Calcium Alginate material was agitated by a 500 revs. per minute stirrer to break it down into suitable fibrous form. The "filled fibre" was strained from the supernatant liquor and was passed to the next stage in the preparation of a paper sheet from a mixture in pulp form of the "filled fibre" with 100% Calcium Alginate fibre (grade CA-33 ex. Alginate Industries Limited, a U.K. Company).

Five minutes before the end of the pulping a sufficient quantity of Calcium Alginate "filled fibres" was added to the pulped stock and dispersed throughout the stock.

Samples of the stock were then taken and diluted according to standard paper making practice and formed into sheets on a paper hand forming machine.

The "filled fibre" prepared in this test contained 73.4% Kaolin. Sheets were also made with the following composition:

| '100% Alginate Fibre' | "Filled Fibre" |
|---|---|
| 75% | 25% |
| 50% | 50% |
| 0% | 100% |

EXAMPLES B and C.

Manufacture of Calcium Alginate Paper

Sheet Containing 33.7% Calcium Carbonate filler.

Both example runs on the pilot-scale Fourdrinier multi-cylinder machine were made from one stock batch in the machine-chest. This stock was made in two separate stages, these being blended in the machine-chest.

Stock Preparation 1:100% Calcium Alginate Stock.

35.0 kg. Calcium Alginate (grade CA-33 ex. Alginate Industries Limited, a U.K. Company) was charged to 250 liters tap water in a steam-jacketed Hydrapulper, to produce a consistency of approximately 6.0%. At an as-supplied moisture content of 60%, this charge of CA-33 represented 14.0 Kg. dry fibres. The charge was beaten for 30 minutes with steam heating to 33°C, to a freeness of 21° Schopper-Reigler. 0.5 kg. alum was added to the charge, as pH control agent, and the stock beaten further until a freeness value of 21° Schopper-Reigler was re-attained. At this value, beating was stopped and the stock was transferred to the machine-chest where it was diluted to 700 liters total volume (i.e. 2% consistency). This stock was held with agitation whilst part II was worked-up.

Stock Preparation II: Filled Fibre Stock: 44.44% Filler: 55.5% Calcium Alginate.

The Hydrapulper was cleaned and dried. 24 kg. CA-33 grade. Calcium Alginate (as above = 9.6 kg. dry fibre; CA-33 at 60% moisture) was charged to the Hydrapulper together with 160 liters tap water, to produce 6% consistency. This was beaten, with steamheating to 37°C, to a freeness of 15° Schopper-Reigler. 9.0 kg. Washing Soda (Hydrated Sodium Carbonate ex. Imperial Chemical Industries) was added incrementally with agitation to produce a mobile gelatinous solution of Sodium Alginate. 12.0 kg. of chemically prepared powdered Calcium Carbonate (120 mesh. B. S. size) was added with agitation to give a uniform dispersion. A solution of 7.6 kg. dry commercial Calcium Chloride in 27 liters tap water was prepared, and added by slow pouring from a bucket to the Hydrapulper charge with agitation. There was an instantaneous conversion to a mobile dispersion of filled 'arachnoidal' fibres. The dispersion was agitated for 15 minutes, and pumped across to the machine-chest where it was bulked with part I of the fibre stock. The whole machine-chest charge was diluted with tap water, under agitation, to 1800 liters total (2% consistency).

This total machine-chest charge was split in half, and run on the pilot-scale Fourdrinier multi-cylinder paper machine as follows.

1st paper machine run: (refiner not used in process)

Half of the machine-chest charge was processed on the paper machine, by passing the refiner, but being fed via the dilution box in the normal way. The machine conditions were as laid out in the Table in FIG. 6.

The product of this run was a yellow/brown sheet of good quality at 150 gsm dry weight. It had the appearance of being "2-sided" i.e. it was obvious on inspection that one side of the sheet contained more of the "filled"fibres than the other. This was due to flotation of the "filled" fibres in the slurry before deposition on the Fourdrinier wire, caused by the fact that the refiner was not used in this run. Shrinkage through the machine was approximately 20%, and the product was reeled from the machine at ca. 27% moisture content.

2nd paper machine run: (refiner used in the process)

The remainder of the machine-chest charge was fed to the paper machine via the refiner (loaded to 6 Amps) and the dilution box in the normal way. The machine conditions were as laid out in the Table in FIG. 6.

The product of this run was a more homogeneous yellow-brown sheet, 150 gsm. dry weight, exhibiting only a slight "2-sided" effect. This was due to an improved pre-screen dispersion due to the use of the refiner, which minimised the flotation effect. There was a shrinkage of approximately 20% through the machine: finished sheet moisture content was ca. 27%.

For examples B and C the paper machine conditions were as set forth in FIG. 6.

Reference will now be made to FIGS. 2, 2A; 3, 3A; 4 and 4A wherein examples are set forth in tabular form.

These examples are concerned with the following aspects of the invention:

a. The capability of the calcium alginate based fibres to contain a large proportion of fillers and still be capable of forming a paper sheet by standard paper-making techniques, b. The capability of these fibres to accept different types of fillers at surprisingly high concentrations, c. The different techniques available for manufacture of filled Calcium Alginate fibres suitable for paper making, and d. The effect on smoking properties including certain fillers into Calcium Alginate.

FIGS. 2, 2A; 3, 3A; 4 and 4A, attached show the quantities of reactants and other ingredients used to prepare, by different methods, a variety of paper sheets incorporating different fillers at varying levels.

For convenience and to avoid unnecessary repetition, the general method used to prepare all the filled fibres, used for subsequent papermaking, in this examples will now be described.

All experiments were carried out in bench scale equipment. The desired weight of Calcium Alginate (grade CA-33 fibrous form ex Alginate Industries Limited), calculated from the desired reactant weight having determined the moisture content of the material, was charged to a high-speed liquidiser. A quantity of cold tap water calculated to be sufficient to provide a final solution viscosity capable of being handled by bench scale equipment, was added and the charge agitated at high speed for a period of time sufficient to disperse the fibrous calcium Alginate throughout the charge water; and clumps of fibrous alginate were broken up by this process.

A quantity of dry powdered Sodium Carbonate, sufficient at least to completely convert and dissolve all the Calcium Alginate used was weighed out, and added incrementally to the agitated Calcium Alginate dispersion. During this process, the dispersion was slowly converted to a smooth viscous, aqueous solution of Sodium Alginate. Agitation was continued long enough to ensure that all solid matter (either Calcium Alginate or Sodium Carbonate) was solubilised by reaction. This Sodium Alginate solution is hereinafter referred to as "solution I".

A second solution, "Solution II", was prepared by dissolving a weight of Calcium Chloride, calculated to at least completely neutralise the Sodium Alginate content of that moiety of "Solution I" chosen to be treated subsequently to prepare fibres, in a quantity of cold tap-water sufficient, at least, to completely dissolve all the Calcium Chloride present. The Calcium Chloride was stirred into the water to produce a clear solution.

The fillers used for incorporation into the fibres were pre-treated where necessary by grinding to reduce their particle sizes. The quantity of filler, calculated to give the required final concentration in the fibres of paper sheet, was weighed out and added to whichever solution desired see FIGS 2–4A incl. throughout which it was evenly distributed by simple agitation.

Fibre formation was effected by bringing the two solutions "I" and "II", one of which contained the filler, together in a manner, and using an agitation method, described separately see FIGS. 2–4A incl. for each experiment.

Subsequently, paper making was carried out by following the standard practice of diluting a sample of fibre stock, prepared as above, with cold water to ca. 0.5% consistency, and gently agitating to ensure good fibre separation and distribution. At this stage, the diluted stock pH. was adjusted to below pH,, 7.0, by means of addition of alum. Paper sheets were then formed by draining the water from the stock on a standard paper-makers wire (screen), and then removing the wet felt from the wire and drying it by means of heat. The quantity of the formed papers was assessed by subjective visual and tactile measurements.

The principle of the method of fibre formation used in these experiments involves preparing separately two aqueous solutions, the first of Sodium Alginate, the second of Calcium Chloride, and then combining these two solutions by different methods of addition and mixing. It will be noted that no mention of the quantities of water used is made in FIGS. 2, 2A, 3, 3A, 4, 4A, this is simply because water is used merely as the vehicle for both fibre formation and subsequent papermaking, and during preliminary experimentation it was shown that the quantity of water present in each fibre precursor solution, and also during fibre formation, did not affect the yield or quality of the products. Water is therefore used at each step in a quantity convenient for the handling of the solution or fibre at that stage, and the quantity will obviously be influenced by the solubility of the reactants concerned, the equipment used to handle the solutions, and ultimately in a production process, by the overall economic considerations.

Also for convenience in these experiments, Calcium Alginate was used as the starting material for preparing the first solution of Sodium Alginate. There is no reason why Sodium Alginate could not be used directly instead, and again in a production situation this may well be the preferred economic route. In these experiments, Calcium Alginate was converted directly to Sodium Alginate in an aqueous environment, by addition of Sodium Carbonate. It is immaterial whether this Sodium Carbonate is added in dry form or in aqueous solution — we found that dry material is quite suitable, providing, obviously, that sufficient water is present to dissolve the Sodium Alginate as it is formed, and provide a final solution of suitable viscosity characteristics for further handling. Furthermore there is no practical reason why other alkaline alginates cannot be used as Calcium Alginate fibre precursors, e.g. Potassium; economic and convenience reasons led us to use Sodium Alginate.

Note that in the event that the Alkaline Alginate precursor solution contains an excess of the alkali (e.g. Sodium Carbonate) that was used to prepare the alkaline alginate from Calcium Alginate, then on reaction with excess Calcium Chloride, a water insoluble Calcium salt will be formed by a double decomposition reaction, and this will tend to be included in the fibre produced. So, unless the stoeciometry of the reactions involved is exact, in practical terms an unlikely event, the fibre product will contain a small percentage of insoluble Calcium salt (e.g. Calcium Carbonate). For present purposes, this does not matter- for example we may wish to incorporate Calcium Carbonate as a filler deliberately, and the 'extra' inclusion brought about by this effect is of no importance.

It will be appreciated that in all the experiments EXCEPT no. 57, an excess of reactant at each step was used (i.e. Sodium Carbonate and Calcium Chloride). This is simply for the reason that exact stoechiometric ratios of reactants (as near as can be practically used, bearing in mind the inexactitude of the molecular weight of the Alginate "radical"), as used in exp. 57, do not, for some unknown reason, give complete conversion to the desired products. Particularly, there is a residue of alkaline alginate in the fibre stock, which quite apart from being economically inefficient does not permit good drainage of water during paper-making web formation. It is for the same reason tha the pre-felting stock is deliberately brought to a pH. of below 7.0 by means of, e.g, alum; it has been shown that papers of a satisfactory quality can be made from these fibres without the deliberate inclusion or formation of an adhesive to hold the fibres together.

The end-use of the sheets must be borne in mind when assessing their quality; whilst the quality of certain papers made 'see FIGS. 2–4A incl.) was assessed as 'fair', or 'good', it is more than likely that the quality of these sheets could be improved by further experimentation or even simply larger scale operation of the process. The main concern is only to provide a paper which is of a sufficient quality for manufacture of tobacco substitute, and on this basis, the large proportion of sheets made by the relatively crude experiments of FIGS. 2 – 4A inclusive were of sufficient quality for these purposes.

Experiments 1–8 inclusive were the earliest laboratory trials carried out, and at that time little attention was paid to the methods of liquor addition to produce the filled fibres. At this stage, it was surprising to us to find that relatively high filler concentrations (up to 55%, expt. 5) could be satisfactorily incorporated into fibres which could then be made into a reasonable paper sheet with no added adhesive binder.

After these experiments, the potential was realised of this method for incorporating, by a relatively cheap process, large quantities of fillers which could improve the smoking qualities of the final paper, and also cheapen the product. The next series of experiments (9 – 14 inclusive) were carried out to investigate more closely the capability of this method for incorporating very high concentrations of filler into the fibres. As a result of these runs, it was found surprisingly that up to 85% of ground active carbon (chosen because of its ability to improve the smoke chemistry of the final paper) could be incorporated into the fibres without problem over this level (except xp 14), fibre formation was difficult. It was also suprising that the levels of filler up to 85% did not unduly affect the subsequent paper making qualities of the fibres.

Experiments 15–19 inclusive were carried out to demonstrate that similarly high levels of carbon black (again useful for improving smoke chemistry) could be incorporated into the fibres by the same process. Again fibre and paper formation were satisfactory, with no undue losses of filler. Microscopic inspection of the fibres showed that (in exp. 17 at 51% filler loading) some fibres were of "arachnoidal" appearance, rather dissimilar to 'normal' paper-making fibres. Even so, paper making from these fibres yielded paper of satisfactory quality.

Experiments 20–27 inclusive were carried out to demonstrate that improved papers, at relatively high filler loadings (10% –60%) could be made from a highly filled fibre (71% filler) by using a calculated dilution of CA-33 fibres (no filler). These latter fibres lent support to the sheet and improved ultimate paper quality. The filler distribution throughout the sheet was, of course, less even than would have been the base if no unfilled CA-33 fibres had been admixed to the stock, but this may not be disadvantageous from the point of view of ultimate smoking quality.

Experiments 28 – 38 inclusive were carried out to demonstrate that suitably sub-divided tobacco (both lamina and stem) can be incorporated into the fibres and ultimate sheet. It is clearly potentially advantageous to be able to use tobacco as "filler" in this product, because it will impart useful qualities of colour, burning, and other tobacco-type (or associated) qualities, particularly on combustion. Economically, this method could be very useful and attractive — for instance, where it is intended to admix either unfilled or non-tobacco filled Calcium Alginat sheet with tobacco for cigarette manufacture, incorporation of tobacco into filled Calcium Alginate sheet could avoid or minimise the necessity for subsequent admixture with tobacco, which could present problems with blending and blend separation (due to different specific gravities) during handling and cigarette manufacture. This technique could also provide a method for utilising otherwise "scrap" tobacco, which could be economically important.

These 10 experiments show that tobacco, ater grinding to obtain the desired particle size, can be successfully incorporated into the fibre structure at levels of up to approximately 50%, and even at up to ca. 70% if some small loss of filler can be tolerated in the white water from subsequent paper making.

Experiments 39–46 inclusive were carried out to demonstrate the ability of the process to incorporate a filler of different particle size — Calcium Carbonate was the chosen filler at 150–200 B.S. MESH and >200 B.S. MESH sieve size ranges. The results of the experiments demonstrated that up to ca. 60% of each size filler could be incorporated satisfactorily into the fibres during their manufacture, and that the paper sheets made subsequently, without other added fibres, were of good quality, i.e. coherent, of good appearance, of adequate tensile strength. It was concluded that, within the size range of fillers used in this experiment, the size of filler particles used was not critical.

Experiments 47–56 inclusive were carried out to determine if there was a preferred method, from the point of view of fibre and subsequent sheet quality, of making the filled fibres. These experiments were carried out ignoring any aspects of processing ease, economics and convenience which might be ultimately important in a production scale process. In order to eliminate some of the more obvious variables, certain conditions were decided upon, e.g. the use of Calcium Carbonate at 51.4% inclusion in the fibre was chosen as a reasonable "middle-course" level of a useful filler to use during the experiments.

The process these experiments were designed to evaluate were as follows:

a. the preferred solution in which the filler was dispersed before fibre formation.

b. the solution addition order — i.e. whether the alginate solution should be added to the Calcium Chloride precipitant solution, or vice-versa.

c. the method of adding the two solutions together for fibre formation with particular reference to the mechanical working of the receptor solution during precipitation and its effects on fibre quality.

A combination of these variables obviously would result in the ultimately preferred process, and these ten experiments are best discussed separately with reference to the FIGS. 2–4A incl. for the experimental conditions used.

Experiment 47 was the 'base-line' experiment, carried out merely to provide a reference product for the succeeding experiments; using the hitherto accepted method of liquor addition, and adding the filler to the alkaline alginate liquor, with only minimal agitation of the receptor alginate solution, good fibres were produced which were used with no further mechanical working to produce good-quality paper sheets.

Experiment 48 demonstrated that one can produce fibres and paper sheets of equally good quality when the liquor addition order is reversed i.e. the alginate added to the Calcium Chloride solution to cause fibre precipitation.

Experiments 47 and 50 were essentially repeats of 47 and 48 except that the filler was added to the Calcium Chloride precipitant liquor. Due to its low solution viscosity (compared to the alginate solution) it was obviously more difficult to keep the filler suspended in the precipitant liquor. It was found that the fibres and paper produced by this method were of comparatively poor quality and consequently the process of experiments 47 and 48 would therefore be preferred. The methods of examples 49 and 50 caused a loss of filler, i.e. incomplete incorporation of filler into the fibres, again indicating a potential weakness in this method.

Example 51 was essentially a repeat of example 48, except that the alginate solution, incorporating the filler, was squirted via a fine nozzle under pressure into the precipitant liquor. The quality of the fibres produced was fair, and even though some comparatively large, lengthy filaments ("worms") were produced initially, these were disintegrated by mild stirring into fibres of a quality suitable for paper making. Subsequent paper quality was moderate.

Example 52 was carried out to examine the virtues of spraying the filled alginate solution via a simple air-actuated paint spray gun onto the precipitant liquor surface. It was surprising to note that fibres were formed (one could expect globules as a result of this method)*, and these of good paper making quality. A skin formed at the air/liquid precipitant bath interface but even this could be disintegrated to good fibres by mild agitation of the liquor. The converse experiment (53), in which the calcium chloride liquor was sprayed into the alginate solution failed to produce any fibres. The next experiment (54) was carried out to see if total transfer of filler to the calcium chloride solution (the sprayed liquor) produced any better effects, but again few fibres were formed, and all the filler was not incorporated into the fibrous or otherwise precipitated material.

*R.H. McDowell, in "Properties of the Alginates", 3rd Edition, 1st reprint (1970), p. 27 first paragraph, teaches the formation of non-fibrous precipitates only.

Example 55, essentially similar to example 51, was carried out to see if adding the filler to the other solution (Calcium Chloride) produced any better effects when this liquor was squirted into the alginate — very little fibrous material was formed, some filler was lost, and this method was less preferable to that of example 51.

Example 56, the converse experiment to example 55, was carried out to examine any benefits brought about by reversing the liquor addition order. The results were generally similar to experiment 55.

During all the preliminary experiments, the reactants used at every step were invariably used in excess (over the exact stoechiometric ratio) to ensure total conversion to product; consequently an excess of sodium carbonate was used to produce the aqueous solution of sodium alginate, and an excess of Calcium Chloride was used to precipitate out all the Calcium Alginate in the subsequent step. It was realised that there may be no virtue at all in using an excess of reactant at each step, and experiment 57 was carried out to investigate this. In this example, a filler level of 35% was chosen arbitrarily, the filler being unsieved Calcium Carbonate, and the method of precipitation the most favourable found (and also the one most used) so far in preceeding experiments. Bearing in mind that the equivalent weight of the alginate radical can never be practically determined at the theoretical value (see R.H. McDowell, "Properties of the Alginates", 3rd edition, 1st reprint 1970, page 5 for a concise explanation of this effect), the true stoechiometric ratio of reactants cannot be used. For this experiment, an equivalent weight of 193 for the alginate radical was assumed (see McDowells book again), and for practical purposes this is felt to be sufficiently accurate, reactant weights were calculated on this basis. As can be seen from the table, this experiment did not produce a good yield of fibres, and therefore this processing regime is not sufficiently efficaceous for the purposes required.

Example 58 was carried out to examine the possibilities of producing filled fibres by ultrasonic agitation of the receptor liquor during precipitation. This was achieved by immersing the beaker of receptor liquor in an ultrasonic bath during the addition of the filled alginate feed stream via a fine pipette nozzle. By this method, very fine fluffy fibres were produced which made good quality paper. A repeat experiment (No. 59) to determine the absolute effect of the ultrasonic agitation, was carried out, using no agitation whatsoever, and surprisingly again very fine fibres were produced, which made good quality paper. It could be assumed from this result that the ultrasonic agitation had only minimal effect, and it is considered that this is possibly due to the fine nozzle used for feeding the alginate liquor into the precipitant solution in both these experiments (58 and 59). This is reinforced by the results of experiment 51 (which was essentially a duplicate, the only major diferences being in the level of filler used and the size of the alginate feed nozzle). Experiment 51 resulted in the production of fibres and some long filaments ("worms"), these being produced by the passage of the alginate liquor at times slowly through a feed nozzle larger than that used in experiments 58 and 59. It appears to be important to control both the nozzle size and alginate liquor feed rate in order to produce fibres of good size, shape and quality.

These experiments in total demonstrate quite clearly that by adding a solid filler material, in finely divided form, to either or both an aqueous alkaline alginate solution or its reactant aqueous calcium chloride precipitant liquor (preferably the former), and bringing the two solutions into contact, one can form calcium alginate in a fibrous form and containing substantially all the filler material, which fibrous material is then suitable for use directly, and without necessarily adding either other fibrous material or a binding agent, for making paper sheet material of a sufficient quality for manufacture (e.g. by shredding) into smoking material, which may be used in cigars, cigarettes, pipes or the like.

Simple smoking experiments have been carried out on some of the products of this invention, by shredding the filled paper sheets and making cigarette samples. The tentative conclusions from this exploratory work are as follows:

a. the inclusion of either Calcium Carbonate, active carbon or carbon black, or finely divided tobacco increases the combustibility of the paper, when compared with unfilled Calcium Alginate paper sheets similarly shredded and wrapped.

b. Calcium Carbonate and particularly Carbon, either activated or as Carbon black, are effective in reducing the gas phase components of the smoke, and also have effect in reducing the tar delivery.

Further experiments were carried out as detailed in FIGS. 8, 8A, 9, 9A, and all column number references are derived from these Figures.

Experiments S14–S34 inclusive were carried out in the laboratory scale apparatus shown in FIG. 10 — the weight (in column 4) of the type of sodium alginate (in column 2) was dissolved in the volume of water (in column 6) by high speed stirring to give a solution of sodium alginate of the concentration in column 7.

The volume (in column 13) of calcium chloride solution of concentration given in column 12 was prepared either by dissolving the solid calcium chloride (weight given in column 10) or by suitably diluting the calcium chloride liquor (in column 11).

The weight of calcium carbonate in column 16 was added to the solution shown in column 17, and thoroughly dispersed.

The weight of carbon in column 20 of the type in columns 18 and 19 was added to the solution shown in column 21, and thoroughly dispersed.

The temperature and pH of the sodium alginate solution and the temperature of the calcium chloride solution were measured and recorded in columns 8, 9 and 14 respectively. The pH of the calcium chloride solution was adjusted to that in column 15 using 3N hydrochloric acid.

The calcium chloride solution was placed in a fibre making vessel (FIG. 10) and was agitated by the method shown in column 25. Sodium alginate solution was pumped into the calcium chloride solution at the rate shown in column 23 over the period shown (approximately) in column 24.

A suspension of fibres of theoretical composition shown in columns 26, 27 and 28 was thereby produced.

Experiment C1 – A similar procedure to Experiments S14–S34 above was followed. In this experiment, however, the freshly precipitated filled fibres were removed continuously over a weir in the wall of the fibre forming vessel approximately 5 inches above the base of the vessel, the experiment being run on a semi-continuous basis. It was found that constant manual assistance was necessary to ensure that the fibre slurry overflowed the weir satisfactorily.

Experiments C2 to C8 — the procedure already described above in relation to Experiments S14–S34 incl., was followed. These experiments were individually run as discreet batches, i.e. on a discontinuous basis. The number of batches per experiment is given under column 29. These batches were bulked and mixed before hand-sheet manufacture.

Experiments P1 and P2 — fibres were prepared using the pilot scale apparatus shown in FIG. 12, and the parameters for the individual feed solutions and the running conditions of each experiment are given in the various columns of FIGS. 8, 8A, 9, 9A.

The fibres formed in Experiments S14–S34, C1–C8, P1 and P2 inclusive were in each case made into paper using the simple apparatus shown in FIG. 12. Circular handsheets of paper were so prepared.

In more detail, the fibre stock prepared in the just referred to Experiments was shaken or stirred to achieve even distribution of fibres. 30–100 ml (normally 75 ml) of fibre stock was removed and diluted to about 800 ml. with water. This diluted stock was stirred and poured with a swirling motion into the top half of the split Buchner funnel (FIG. 13). The swirling motion was stopped and the fibres were then distributed evenly by gentle side-to-side agitation with a glass rod. After 30 seconds the stoppered PVC tube was removed and the water allowed to drain. The top half of the split funnel was removed, and the Fourdrinier wire was removed, inverted and pressed by hand onto a wad of 6 "Whatman" No. 1 filter papers. The wire was removed and washed in running water ready for the next handsheet. The wet handsheet was lifted with the top filter paper, and a wad of four filter papers was placed on top. The wad was rolled by hand with an aluminium roller. The handsheet was then coherent enough to lift by itself. Further drying was achieved by pressing between wads of 3 to 5 filter papers.

In experiments C1 to C8 about 60 circular handsheets were made from the bulked fibres in each experiment. Basis weights were about 80–100 gsm dry matter.

The handsheets, interleaved with dry filter papers, were held flat by weights for varying period of time such that the moisture contents ranged from about 20% to about 55%.

The greater proportion of handsheets from each experiment were then taken in sets of 8, rolled into a total of 32 thicknesses and cut on a small 'Hauni' flake cutter. All samples cut well into long coherent strands. Rapid drying in a warm air stream imparted to the strands a large degree of curl. Other methods of rapid drying also gave a large degree of curl. The dried cut strands held together extremely well, even when the mat of randomly intertwined fibres was cut into half inch widths.

Cigarettes were prepared from the dried cut strands by hand using preformed paper tubes with filters attached. Each batch was equilibrated with air at 22°C, 65% RH and smoked using normal parameters on an analytical smoking machine. Results are appended in FIG. 13.

It is considered surprising that the calcium alginate is capable of accepting very high concentrations of filler material, up to ca. 90% which is relatively evenly distributed throughout its fibrous structure by the process of this invention, and that the filled fibres thus formed are capable of being used directly for paper making without either added other fibrous material or deliberately added, or formed n-situ, binder. Furthermore the paper sheets so formed are of good appearance, pliability and tensile strength.

Even more surprising is the fact that filled fibres of calcium alginate, hich are suitable directly for paper making without added binder or other fibrous material, can be made by a process which would normally be expected to produce a flocculant or gelatinous precipitate (see McDowell's book p. 27).

It would therefore appear that calcium alginate has a natural propensity to form fibres when precipitated in the manner of this invention, even if one reactant fibre precursor solution is merely poured into the other with only comparatively mild agitation. We are unable to give any satisfatory explanation for this effect.

The term 'filled fibre' is not necessarily descriptive of the product as the actual material formed sometimes tends to have appearance of a 'micro-spider' rather than a fibre proper.

It is not necessary to use spinnerets for the forming of the filled fibre at the precipitation stage. Provided that the Calcium chloride solution is agitated as described the alginate solution can be introduced in a continuous stream.

Surprisingly in this latter method it is found that even if the filled calcium alginate is produced in lump or film form, agitation will break it up easily into 'fibres' suitable directly for paper making. An alternative method of preparation of the 'arachnoidal' fibres is to suspend the filler in the alginate solution and spray calcium chloride solution into the alginate solution, breaking up the formed fibres by agitation.

What we claim is:

1. A process of incorporating filler material into a basic material comprising an insoluble alginate, which can be made in fibrous form by the admixture of two solutions, in which the filler material is suspended in at leat one of the solutions in such quantity and the solutions are so mixed that the filler is incorporated integrally in the fibres themselves as they are formed so as to constitute more than 10% of the fibres by weight.

2. A process of manufacturing a smokeable material including a basic material consisting of calcium alginate in fibrous form, into which filler material is incorporated, in which the calcium alginate fibres are formed from the admixture of two solutions, the filler material being suspended in at least one of the solutions in such quantity and the solutions being so mixed that the filler is incorporated integrally in the fibres themselves as they are formed so as to constitute more than 10% of the fibres by weight.

3. A process as claimed in claim 2, in which the quantity of filler in the fibres is more than 50% by weight of the fibres.

4. A process in which substantially all the filler material added to the calcium alginate necessary to form the fibres from which a complete smokeable material can be made is incorporated in the fibres as setforth in claim 3.

5. A product made by the process set forth in claim 2.

6. Cigarettes, cigars or pipe tobacco including the product set forth in claim 5.

7. A process of manufacturing a smokeable material including a basic material consisting of calcium alginate in fibrous form, into which filler material is incorporated, in which the calcium alginate fibres are formed from the admixture of two solutions, the filler material being suspended in at least one of the solutions in such quantity and the solutions being so mixed that the filler is incorporated integrally in the fibres themselves as they are formed so as to constitute more than 50% by weight of the fibres and thereafter forming the fibres incorporating the filler into a sheet by a paper making process and subsequently shredding the paper to form the smokeable material.

* * * * *